US010851535B2

(12) United States Patent
Gajo

(10) Patent No.: US 10,851,535 B2
(45) Date of Patent: Dec. 1, 2020

(54) SELF-CLEANING, LIGHTED URINAL ATTACHMENT FOR CONVENTIONAL TOILETS

(71) Applicant: Reno Gajo, North Vancouver (CA)

(72) Inventor: Reno Gajo, North Vancouver (CA)

( * ) Notice: Subject to any disclaimer, the term of this patent is extended or adjusted under 35 U.S.C. 154(b) by 85 days.

(21) Appl. No.: 16/261,008

(22) Filed: Jan. 29, 2019

(65) Prior Publication Data

US 2020/0240128 A1 Jul. 30, 2020

Related U.S. Application Data

(60) Provisional application No. 62/623,551, filed on Jan. 30, 2018.

(51) Int. Cl.
*E03D 13/00* (2006.01)

(52) U.S. Cl.
CPC ..... *E03D 13/00* (2013.01)

(58) Field of Classification Search
CPC ..... E03D 13/00; E03D 11/12; E03D 11/02; E03D 11/13; E03D 13/002; E03D 11/025; A47K 11/12
USPC .... 4/307, 301, 300, 312, 340, 341, 342, 661
See application file for complete search history.

(56) References Cited

U.S. PATENT DOCUMENTS 2,611,134 A * 9/1952 Jarrett ..... E03D 11/12 4/312
2,678,450 A * 5/1954 Simpson ..... B61D 35/005 4/312
3,412,408 A * 11/1968 Michal, Jr. ..... E03D 11/025 4/301
3,822,419 A * 7/1974 Wilson, Sr. ..... E03D 13/00 4/144.4
4,282,611 A * 8/1981 O'Day ..... E03D 11/025 4/144.1
5,134,728 A * 8/1992 Sturm ..... E03D 11/12 4/307
5,301,374 A * 4/1994 Smiley ..... E03D 11/025 4/341
5,737,779 A * 4/1998 Haddock ..... E03D 13/00 4/301
5,819,331 A * 10/1998 Miuccio ..... E03D 11/025 4/341
6,061,844 A * 5/2000 Barton ..... E03D 1/145 4/340
2012/0246816 A1* 10/2012 Jung ..... A47K 11/12 4/341

* cited by examiner

*Primary Examiner* — Justin M Jonaitis

(57) ABSTRACT

The object of this urinal attachment is to prevent men from splashing urine into the bathroom floor whenever they urinate in standing position. The attachment, entirely mounted on the gap between toilet seat and toilet water tank, has a funnel connecting to top end of an extendable tube with a bottom end fastened at and draining urine into the toilet bowl, an arm for manipulating the funnel and the tube, to move the funnel close to crotch area before use or to replace the funnel and the tube into storage position. Many prior art do not have covers; they appear to be extraneous or unsightly devices in the bathroom. This invention is aesthetically pleasing because its novel location allows for a casing that hides the attachment when not in use and that blends well in color, texture and symmetry of conventional toilets.

1 Claim, 8 Drawing Sheets

FIG. 7
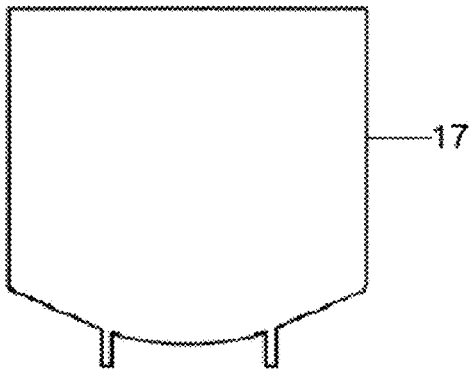
FIG. 8
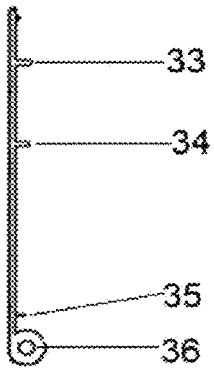
FIG. 9
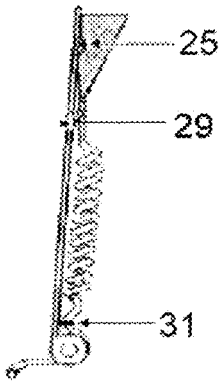
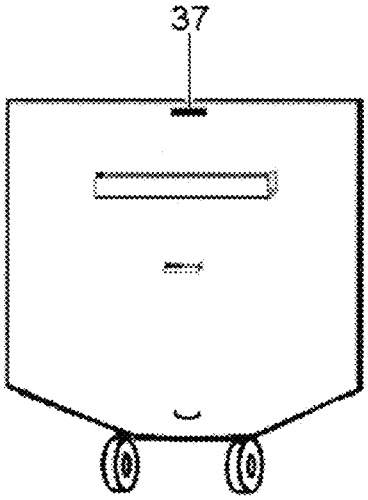
FIG. 10
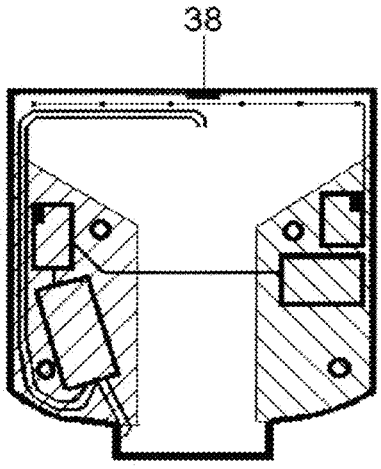
FIG. 11

SELF-CLEANING, LIGHTED URINAL ATTACHMENT FOR CONVENTIONAL TOILETS

CROSS-REFERENCE TO RELATED APPLICATION

This application claims the benefit of U.S. Provisional Utility Patent Application No. 62/623,551 filed Jan. 30, 2018 by the present inventor.

FIELD OF THE INVENTION

The present invention relates to human waste disposal systems. More particularly, the invention relates to urinal attachments for conventional toilets.

BACKGROUND

Most houses are built without urinals so that conventional toilets are used for defecation and urination. Men prefer to stand, rather than sit down, when urinating. This results in droplets of urine ricocheting and sprinkling out of the toilet bowl and building up into a fine layer of urine covering the floor. At night, whenever men choose to stand and urinate in the dark because turning on the bathroom lights could make it difficult to get back to sleep, there is always a chance that the target bowl would be missed and urine is likely to splatter all over the toilet and the floor. While the toilet seat is lifted out of the way before urination, users sometimes forget to put down the seat afterwards—a source of irritation to the next user who has to seat down when defecating, or when urinating in case of women.

Consequently, the urination position preferred by men contributes to foul-smelling and unsanitary condition of bathrooms, the need to clean toilets and surrounding areas more often, and a recurring source of annoyance to next users. For many home owners, installing free-standing urinals requires expensive plumbing modifications. Therefore, attaching urinals to existing toilets to allow men to stand for spill-free urination is a cost-effective solution.

The desirable features of such an attachment are:

1. There should be no plumbing work. Plumbing modifications mean more expenses.
2. Easy to install and uninstall without leaving permanent marks. Most adults should be able to install it quickly without professional help and remove it quickly when no longer required or when there is no more resident male.
3. Does not require extra bathroom space. The bathroom is usually a compact area so that adding another device makes it more crowded.
4. Provides for automatic after-use cleansing of the urinal and there should be no extra cleaning of the urinal attachment or its components (due to the reason described by feature no. 8 below).
5. Aesthetically pleasing, giving the impression that the attachment is an integral part of the toilet configuration rather than an extraneous appendage detracting from the usually straightforward design of toilet areas.
6. Suitable for men of different heights.
7. Provides for automatic subdued lighting in lieu of turning on the brighter bathroom lights which could make it difficult for those that urinate multiple times at night to get back to sleep.
8. No need to pull up the toilet seat when urinating. Bits of feces ricochet to underside of seats whenever users suffer from diarrhea or deposit lots of watery stool. It is no surprise that some people, having lifted the seat before urinating and having seen what is on its underside, may not even touch the seat afterwards, Out of over two dozen related prior art, 8 U.S. patents score positively on no more than 5 out of the 8 desirable features. U.S. Pat. No. 8,032,955 issued to Emerson in October 2011 scores positively on 5 features (i.e. 1, 2, 3, 5 and 6). On the other hand, this attachment has no automatic cleansing, no subdued lighting and requires lifting of seat. It is placed between the toilet seat and the toilet bowl and hidden from view when not in use, but it is susceptible to being smeared by ricochets of feces whenever users deposit lots of watery stool, thus additional cleaning is required. U.S. Pat. No. 7,412,732 issued to Leonard in Aug. 2008, U.S. Pat. No. 5,373,589 issued to Rego et. al. in December 1994, U.S. Pat. No. 5,216,760 issued to Brown in June 1993 and U.S. Pat. No. 4,348,776 issued to Sarjeant in September 1982 score positively on 4 features (i.e. 1, 2, 3 and 5) and they do not have automatic cleansing of the urinal, do not have adjustable heights, do not have subdued lighting, and require lifting of seats. U.S. Pat. No. 5,819,331 issued to Miuccio in October 1998 scores positively on 4 features (i.e. 3, 4, 5 and 8) but it requires plumbing work, not easy to install, not adjustable height and has no subdued lighting. U.S. Pat. No. 4,060,859 issued to Anderson in December 1977 scores positively on 4 features only (i.e. 1, 2, 4 and 6). U.S. Pat. No. 2,980,919 issued to Otto et. al. in April 1961 scores positively on 4 features (i.e. 1, 2, 3 and 4).

On the other hand, this present invention scores positively on all 8 features because it is mounted centrally and entirely on the narrow gap between the toilet seat and the water tank of conventional toilets. In its storage position, this invention does not interfere with normal toilet operation. Its location allows for a casing that is aesthetically pleasing, blending well in color, texture and symmetry with most conventional toilets. In addition, this invention has small battery-powered subdued light(s) for night-time use and a battery-powered, miniature water pump that automatically flushes the funnel after use.

BRIEF SUMMARY OF THE INVENTION

The present invention is a urinal attachment for conventional toilets comprising a flexible funnel, an extendable, coiled tube, and an upright, hollow arm with a perpendicular, pivoting handle and a hook. The flexible funnel has a wide mouth for accepting urine and a narrow stem for dispensing urine. The stem of the funnel is connected to the top end of a tube and the bottom end of the tube drains urine into the toilet bowl. The stem of the funnel and the top end of the tube, having been connected, are secured inside the hollow arm. The handle controls the movement, in unison, of the arm, the funnel and the tube, as in pulling the funnel upwards or sideways as close as possible to crotch area for spill-free urination. The tube extends or retracts to accommodate the user's height. There is a casing for covering the funnel and the arm when the urinal is not it use.

The attachment has a lighting module that automatically provides lighting while the urinal is in use, such lighting being suitable for subdued night-time illumination.

The attachment has a module for automatic, after-use cleansing of the funnel and the tube. It takes a few seconds for the module to cleanse the urinal.

The attachment is mounted on the narrow gap between the toilet seat and the toilet water tank.

BRIEF DESCRIPTION OF THE DRAWINGS

Some embodiments of the present invention are illustrated as an example and are not limited by the figures of the accompanying drawings.

Drawing sheet 1/8 includes a front view (FIG. 1), a side view (FIG. 2), and a top view (FIG. 3) of a conventional toilet, identifying a shaded area where the urinal attachment is to be mounted.

Drawing sheet 2/8 includes FIG. 5 that shows the components of a funnel assembly comprising the flexible funnel, the extendable, coiled tube, and the upright, hollow arm with the perpendicular, pivoting handle and the hook. At the bottom of the sheet.

Drawing sheet 3/8 includes a front view (FIG. 7), side views (FIGS. 8 & 9) and an inside view (FIG. 10) of the front cover as well as an inside view (FIG. 11). of the back cover. This sheet is about how the funnel assembly is secured between the front and the back covers.

Figure 14:
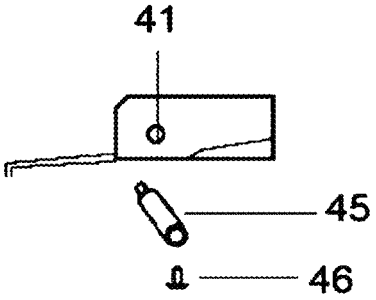
Figure 15:
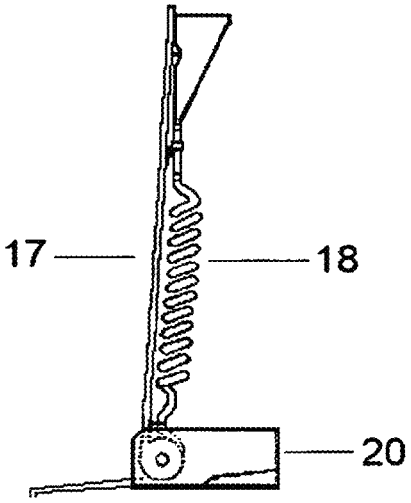

Drawing sheet 4/8 includes a front view (FIG. 12), an underside view (FIG. 13) and a side view (FIG. 14) of the base. FIG. 15 shows how the front cover, with the assembly attached, is pivotably secured to the base.

Figure 17:
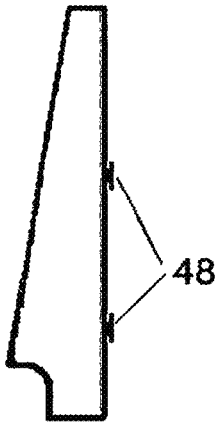
Figure 18:
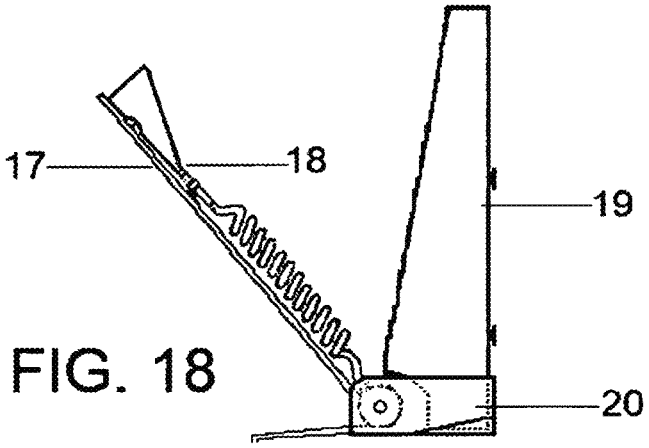

Drawing sheet 5/8 includes an inside view (FIG. 16) and a side view (FIG. 17) of the back cover which houses the lighting and the cleansing modules of the attachment. FIG. 18 shows the front cover, the funnel assembly and the back cover secured inside the base.

Figure 19:
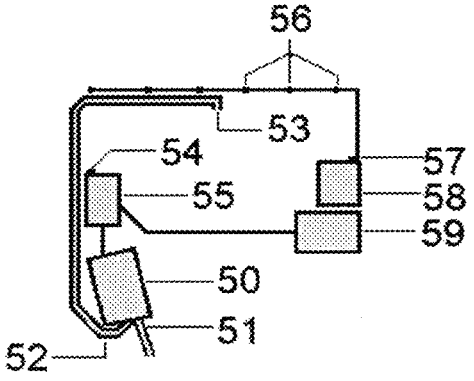
Figure 20:
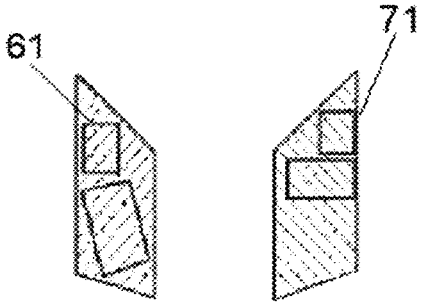
Figure 21:
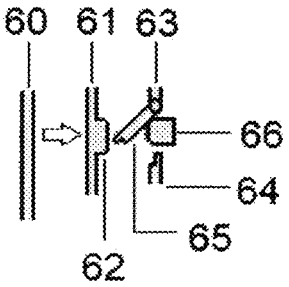

Drawing sheet 6/8 is about the cleansing and the lighting modules that are housed in the back cover. FIG. 19 shows the components of the modules and FIG. 20 shows the water-proof plastic sheets and cases that protect the moisture-sensitive components. FIG. 21 details the manual switch of the cleansing module and FIG. 22 details the manual switch of the lighting module.

Figure 23:
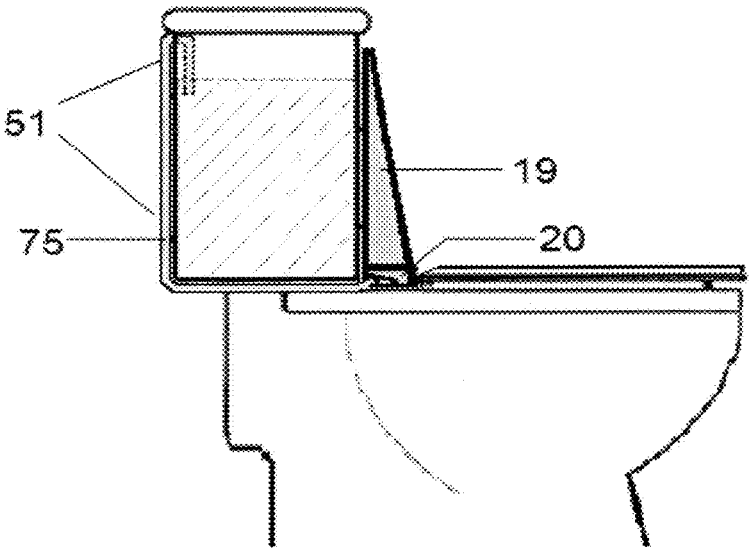
Figure 24:
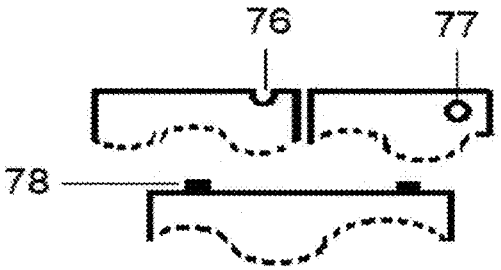
Figure 25:
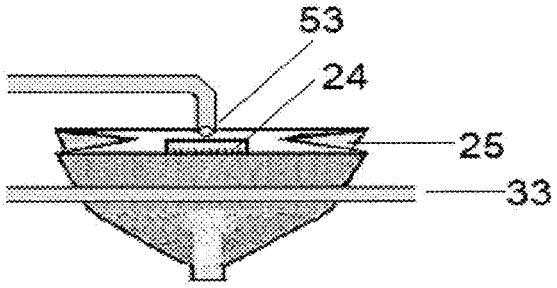

Drawing sheet 7/8 is about the input and output tubes of a miniature water pump of the cleansing module. FIG. 23 shows how the input tube goes around the underside and the back wall of the water tank. FIG. 24 shows three ways of inserting the input tube through the back of the water tank. FIG. 25 shows the end of output tube being positioned above the funnel when the funnel assembly is compressed between the covers.

Figure 26:
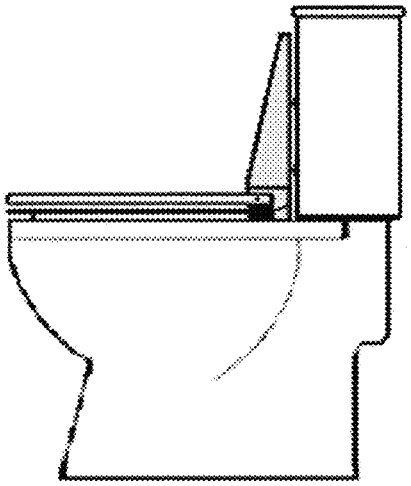
Figure 27:
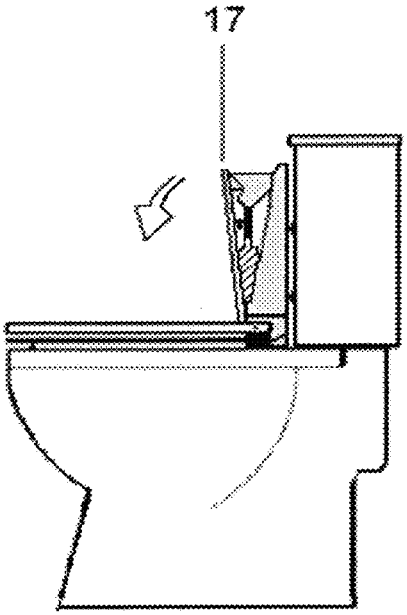
Figure 28:
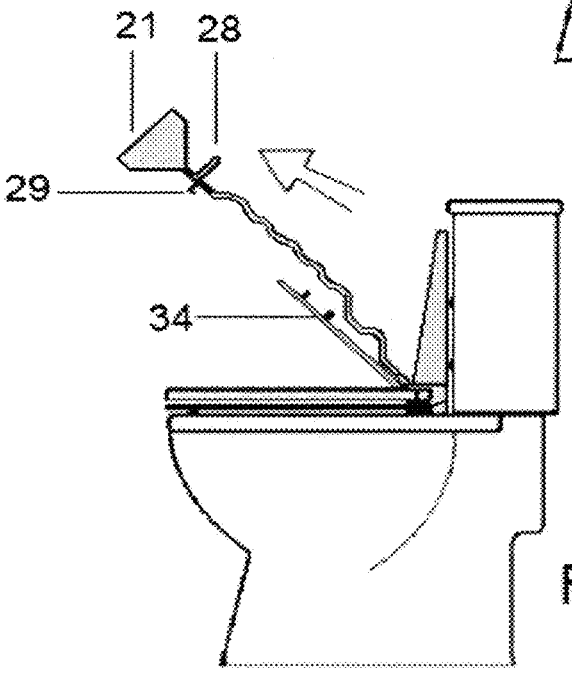

Drawing sheet 8/8 includes three side views of a toilet with the urinal attachment. FIG. 26 shows the shaded urinal mounted on the gap. FIG. 27 shows the front cover being opened when the urinal is to be used, and then FIG. 28 shows the funnel assembly to be pulled as close as possible to crotch area of the user.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an" and "the" are intended to include the plural forms as well as the singular forms, unless the context clearly indicates otherwise. It will be further understood that the terms "comprises" and/or "comprising", when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The components, parts and modules of the urinal attachment, how they operate together are discussed herein. In the following description, for purposes of explanation, numerous specific details are set forth in order to provide a thorough understanding of the present invention. It will be evident, however, to one skilled in the art that the present invention may be practiced without these specific details.

Figure 1:
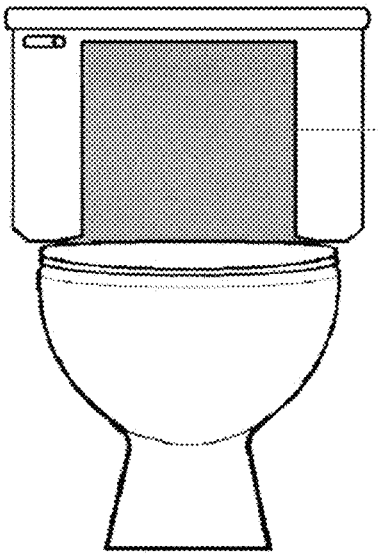
Figure 2:
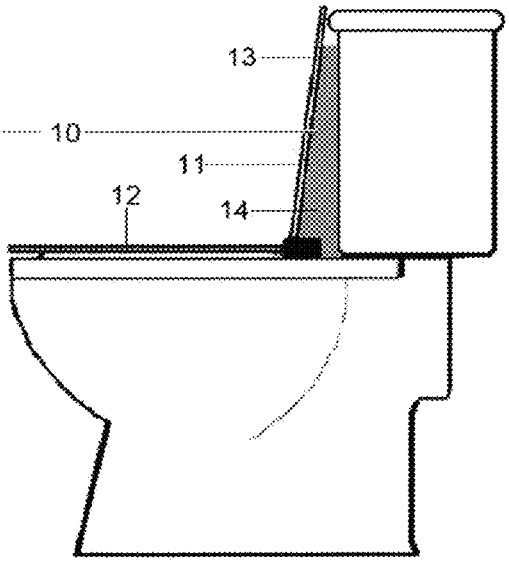
Figure 3:
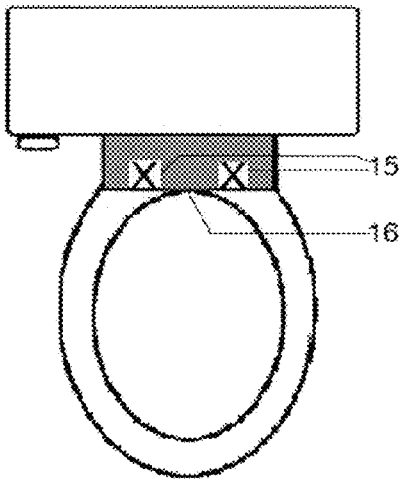

This part of specification refers to drawing sheet 1/8. FIG. 1 and FIG. 2 show shaded area 10 on conventional toilets where the urinal attachment is to be mounted: on the gap between the toilet seat and the front wall of toilet water tank. This unused, shaded area represents the clearance and angle needed for the toilet seat cover and seat to be pulled upright without dropping back down. The top 13 of the shaded area is at least one inch of clearance (depth), and the bottom 14 is at least two inches of clearance. The crossed areas 15, about three inches apart and raised about an inch, are occupied by the back of toilet seat and cover. The attachment needs an area that is about 10 inches high, 10 inches wide, 1 inch deep at the top and 2 inches deep at the bottom. In addition, the front wall of the toilet water tank should be relatively flat as in the case of many toilet designs.

Figure 4:
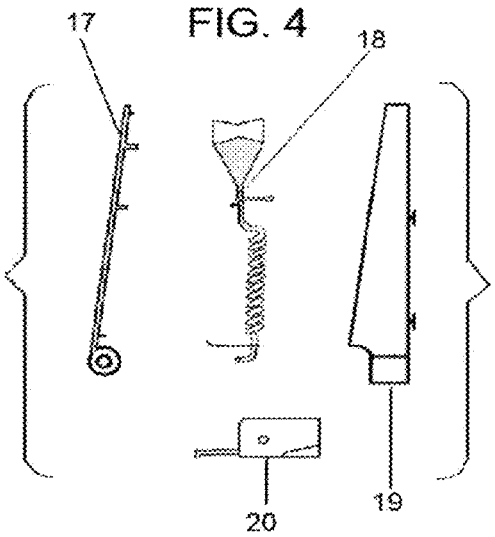
FIG. 4 is an exploded view of the attachment.

The attachment does not interfere with lifting of toilet seat cover 11 and toilet seat 12, flushing, removal or replacement of water tank cover. The attachment discharges urine into the toilet bowl through a slit 16 between the toilet seat and the toilet bowl. FIG. 4 shows some components of the attachment: a funnel assembly 18 comprising a flexible funnel made of shape-memory polymers such as silicone, plastic, rubber or other suitable materials that is connected to an extendable, coiled tube made of said materials, an arm with a handle made of said materials that houses the connected sections of the funnel and the tube; and a casing made of porcelain, ceramic or said materials comprising a front cover 17, a back cover 19 and a base 20, which casing being the storage location of the assembly. The lighting and the cleansing modules, which are inside the back cover but not visible from this particular figure, are described later in conjunction with drawing sheet 6/8.

This part of specification refers to drawing sheet 2/8which is about the components of funnel assembly comprising the flexible funnel 21, the extendable, coiled tube 23 and the upright, hollow arm 22 with the perpendicular, pivoting handle 28 and the hook 29. The funnel may be twisted or compressed but, when the pressure is removed, the funnel returns to its original, open-mouthed shape. When compressed, the funnel folds at its midsections 25. In an alternative embodiment, the shape of the funnel, the arm or the tube and how they cooperate may vary and may be combined into one object.

When compressed between the front and the back covers, the funnel is slightly open, to allow for water to be pumped in. Water passes through a perforated pouch 24 on the inside of the funnel. The pouch is intended to hold a disinfectant strip that mixes with water to cleanse the funnel and the tube.

The top end 30 of the tube is connected to the stem 26 of the funnel. Whereas the tube as shown has 12 coils, alternative embodiments may require more coils to accommodate very tall users. A string 31 ties the lower part of the tube to the front cover to prevent the end of the tube from getting dislodged whenever the tube is extended or retracted. In an alternative embodiment, the string may be replaced by a clip and/or a fastener.

The stem of the funnel 26 and the top end of the tube 30 are secured inside the hollow 27 of the arm. The handle 28 may be turned 360 degrees in either direction, pulled upwards or sideways to allow for right- or left-handed manipulation of the assembly. In an alternative embodiment, the arm may not be a hollow object and may not have a handle provided it serves the purpose of moving the assembly components in unison.

Figure 5:
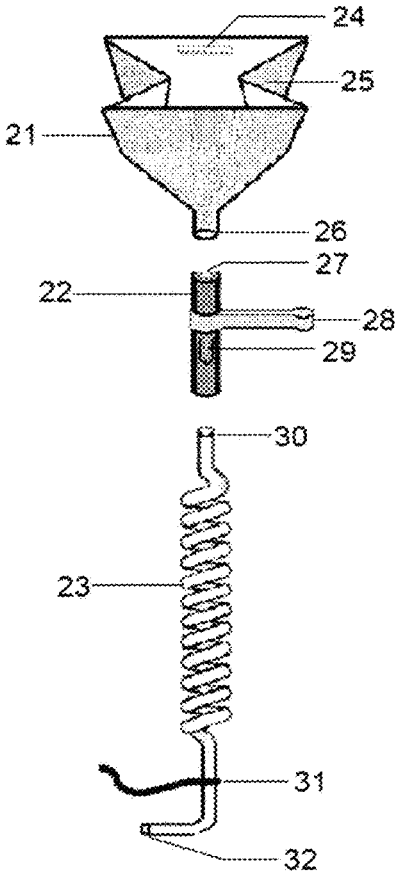
FIG. 5 shows the components as assembled.
Figure 5A:
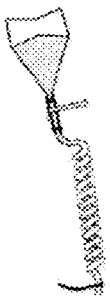
Figure 6:
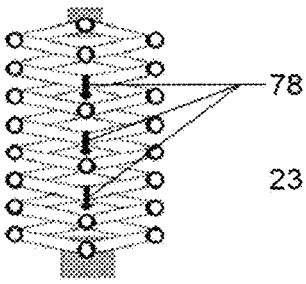
FIG. 6 shows an alternative embodiment of the arm and FIG. 6A shows how the tube is coiled along the alternative arm.
Figure 6A:
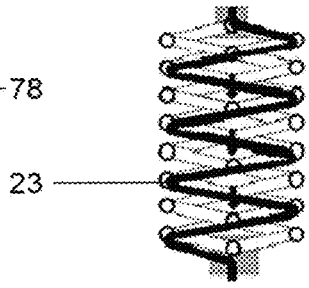

There are 3 figures at the bottom of the sheet. FIG. 5A shows the funnel assembly as configured: the funnel 21 connected to the coiled tube 23 and held together by the arm 22. When not in use, the funnel assembly is hooked 29 to the inside of the front cover as described later in conjunction with drawing sheet 6/8. In an alternative embodiment, an extendable arm with multiple hooks 78 of FIG. 6 may replace the arm to allow for a hands-free urination. When the arm is extended, one of the hooks 78 may be secured to the top edge of the front cover. The top hook secures the extended arm at a height suitable for shorter users, the middle hook or hooks are for users of average height and the bottom hook is for taller users. The hooks 78 may be removable so that they can be attached to different rungs of the arm, as well as color-coded to help different users identify the hooks 78 that suit them. FIG. 6A shows how the tube is coiled along the rungs of the arm.

This part of specification refers to drawing sheet 3/8 which is about the front cover. FIG. 7 is a front view, FIG. 8 is a side view and FIG. 9 shows, when the funnel assembly is in its storage location, the hook 29 of the assembly secured to the eye 34 of the cover, the raised bar 33 of the cover pressing on the midsection 25 of the funnel, and the end of the tube permanently secured by string 31 tied to lower eye 35 of the cover. The holes 36 are used to pivotably bolt the cover to the base as described in the next drawing sheet, and the purpose of the raised is discussed in conjunction with the cleansing module as detailed by drawing sheet 7/8.

FIG. 10 shows a small magnet 37 that is secured near the top on the inside of front cover. On the opposite side, FIG. 11 shows another small magnet 38 that is secured near the top of the back cover. When the front cover is shut against the back cover, the attracting magnets ensure that the funnel is firmly compressed between the covers. In an alternative embodiment, a different device may replace the magnets.

Figure 12:
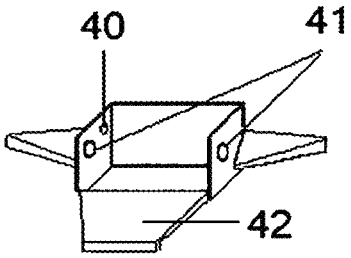
Figure 13:
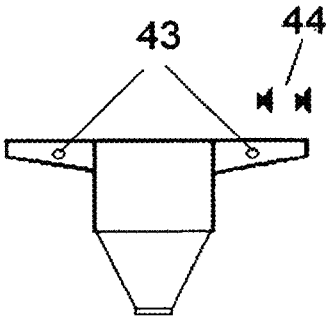

This part of specification refers to drawing sheet 4/8 which is about the base of the casing. FIG. 12 is the front view showing a small hole 40 through which the intake tube of the miniature water pump connects to the backside of the toilet water tank, a thin downward sloping nozzle 42 that is inserted between the slit between the toilet bowl and the toilet seat and through which urine and water flows into the toilet bowl, and a pair of holes 41 used for pivotably bolting the front cover to the front section of the base. FIG. 14 shows one of the holes 41 plus a bolt 45 and a nut 46. FIG. 13 is an underside view showing holes 43 through which suction cups 44 secure the base to the toilet. FIG. 15 shows the funnel assembly 18 hooked to the front cover 17 that is secured to the front section of the base 20.

Figure 16:
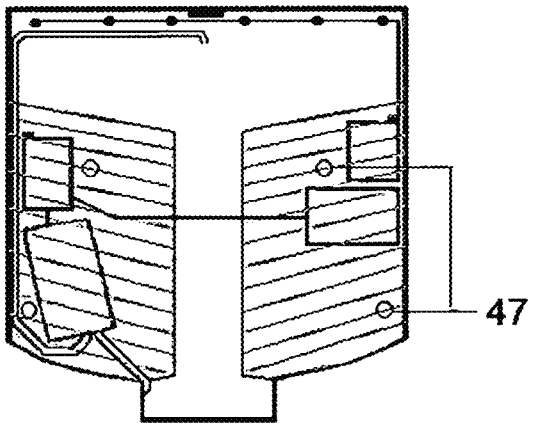

The base catches water or urine overflowing from the funnel and redirects the same into the nozzle 42 of FIG. 12. In an alternative embodiment, the nozzle 42 of FIG. 12 may be detachable or adjustable to cater for variances (in the distance between toilet walls and back rims of toilet bowls) that exist among different toilet brands This part of specification refers to drawing sheet 5/8 which is about the back cover, how it is secured to the toilet water tank and how it relates to the base and the front cover. FIG. 16 reveals the inside of the back cover including the components of the cleansing and the lighting modules which are discussed later in this specification. The back cover has holes 47 through which suction cups are inserted and attached to the front wall of water tank. FIG. 17 is a side view showing two of the suction cups 48. FIG. 18, is the urinal attachment configuration showing the front cover 17 with attached funnel assembly 18 and bolted to the front section of the base 20 and the back cover 19 placed inside the base opposite the front cover.

Drawing sheet 6/8 illustrates the cleansing and the lighting modules that are attached to the back cover. FIG. 19 shows the modules while FIG. 20 shows the water-proof sheets and plastic casings of the moisture-sensitive components of the modules.

The cleansing module is comprised, of a miniature water pump 50 with an intake tube 51 that draws water from toilet water tank and an outlet tube 52 that runs up an edge of the back cover and ending at a point 53 directly above the slightly open funnel when said funnel is compressed between the covers, a time delay switch/mechanism 55 that is connected to the pump, to a pump battery 59 and to a manual pump switch 54. The manual switch is turned on by the action of closing the front cover. The switch, in turn, activates the mechanism that runs the pump for a preset number of seconds needed to fill the funnel to the brim with or without overflowing. Overflows are directed by the covers into the base, into the nozzle 42 of FIG. 12 and down to the toilet bowl.

FIG. 21 is a side view illustrating a small section 60 of the front cover around the manual pump switch 54 area, a corresponding section 61 of the water-proof sheet with a fixed bulge 62, and the manual switch comprising an upper contact point 63, a lower contact point 64 and a lever 65 for turning the electric current on or off. When the front cover is closed in the direction of the arrow, the cover presses on the water-proof sheet 61 with a fixed bulge which, in turn, presses the lever 65 to connect with the lower contact 64 and at the same time compresses the flexible bulge 66 attached to the back cover. Thus, the action of closing the front cover turns on the manual switch. In turn, the switch activates the time delay switch/mechanism for a pre-programmed number of seconds. In turn, the mechanism activates the miniature water pump. The pump draws water from the toilet water tank and pours it into the slightly open funnel which is compressed between the covers. At the end of the preset number of seconds, the mechanism cuts off the connection to the pump and the batteries and overrides the manual switch.

The action of opening the front cover in the opposite direction of the arrow disconnects the manual switch, releasing the pressure on the water-proof sheet 61 with the fixed bulge 62, which, in turn releasing the pressure on flexible bulge 66 attached to the back cover, so that the latter bulge pushes the lever 62 away from the lower contact point 64. However, these actions have no effect on the water pump since the mechanism logically disconnects the pump a few seconds after the front cover is closed.

The lighting module comprises several small lights 56 strung across the top of the back cover, controlled by a manual light switch 57 that is connected to the light battery 58. The action of opening the front cover turns the light switch on. The action of closing the cover turns the light switch off.

Figure 22:
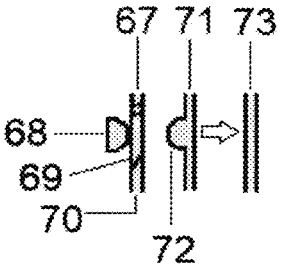

As to the light switch, FIG. 22 shows a side view of a small section 73 of the front cover around the light switch 57 area, a corresponding section 71 of the water-proof sheet with a fixed bulge 72, and the manual light switch comprising an upper contact point 67, a lever 69, and a lower contact point 70. When the front cover is opened in the direction of the arrow, the cover releases the pressure on the water-proof sheet 71 with the fixed bulge 72 which, in turn, releases the pressure on the flexible bulge 68 attached to the back cover thus the latter bulge 68 pushes the lever 69 towards the lower contact point 70 and turning on the switch and the lights.

Still on FIG. 22, when the front cover is closed in the opposite direction of the arrow, the non-flexible bulge of the sheet 72 presses on the lever 69, disconnecting the lever from the lower contact 70 and compressing the flexible bulge 68 attached to back cover. Thus, the light switch is turned off.

In an alternative embodiment, the manual switches may use springs and/or other means instead of flexible and non-flexible bulges.

The water-proof sheets are secured to opposite sides of the back cover. The left sheet has casings for a time delay switch/mechanism and a miniature water pump. The right sheet has casings for pump and light batteries. The casings allow for easy replacement of module components.

This part of specification refers to drawing sheet 7/8 which depicts the locations of the input tube and the end of outlet tube of the miniature water pump. FIG. 23 illustrates a side view of a toilet with the urinal attachment in place. In its storage position, only the back cover 19 and base 20 of the attachment are showing. The output tube 51 runs around the underside of the water tank and drops into the back section of the tank away from internal components of the tank. Suction cup or cups 75 support the input tube. FIG. 24 shows three ways of inserting the intake tube into the tank. Some toilet manufacturers provide for a cut 76 or a hole 77 in the back wall through which the tube may run through and drop a few inches below the water line. In the absence of an aperture, plastic wedges 78 may inserted between the back wall and the lid of the water tank. In an alternative embodiment, the location of the intake tube may be different from the drawings, one such embodiment having the intake tube going up the attachment's back cover and dropping into the front section of the water tank, wherein wedges are placed on the front wall of the tank. The shape of the back cover, the base and the front cover may change to fit this alternative embodiment.

FIG. 25 illustrates the funnel when it is compressed between the front and the back covers. The funnel is slightly open but folded at its midsections 25. The end of outlet tube 53 is positioned just above the pouch 24 inside the funnel. The raised bar 33 of the front cover is pressing the midsection. The raised bar restricts water outflow so that the funnel is filled to the brim with or without overflowing. Overflows are directed by the covers into the base, into the nozzle 42 of FIG. 12 and into the toilet bowl. Part of the disinfectant strip dissolves with water into a cleansing solvent. When the time delay switch/mechanism deactivates the pump, the solvent drains into the toilet bowl and cleansing the funnel, the coiled tube, the base and the nozzle 42 of FIG. 12 along the way.

This part of the specification refers to drawing sheet 8/8 which consists of three views of a conventional toilet with a lightly shaded urinal attachment in place. FIG. 26 shows the attachment in its storage position, blending with and appears to be an integral part of the toilet configuration. When the urinal is used, FIG. 27 shows the front cover 17 to be pulled down in the direction of the arrow. As soon as the cover is opened, the subdued lights turn on. FIG. 28 shows the front cover completely pulled down, resting at an angle and propped up by rear side of the seat cover. The handle 28 is used to remove the hook 29 from the eye 34 and to pull the funnel 21 close to crotch area of the user. Afterwards, the funnel assembly is hooked back to the front cover, and the front cover is closed and clamped to the back cover. At this point, the lights turn off while the miniature water pump momentarily activates and cleanses the funnel, the coiled tube, the base and the nozzle 42 of FIG. 12. Then the user may flush the toilet.

Accordingly, it is to be understood that the embodiments of the invention herein described are illustrative of the application of the principles of the invention. Reference herein to details of the illustrated embodiments is not intended to limit the scope of the claims, which themselves recite those features regarded as essential to the invention.

What is claimed:

1. A urinal attachment mounted and located on a narrow gap between a toilet seat and a water tank of a conventional toilets comprising:

a funnel assembly comprising:

a flexible funnel having an open mouth and a narrow stem;

an extendable tube having a first open end connected to said stem and having a second open end for draining urine into a toilet bowl; and an upright arm having a perpendicular handle and a hook, with said arm holding said funnel and said tube and said handle manipulating said assembly into an operational position and a nonoperational storage position; and a casing for covering said funnel assembly comprising:

a base having a downwardly sloping nozzle for a front side whereby said nozzle is located between said toilet seat and a rear of said toilet bowl and whereby said base is attached to said toilet by at least one suction cup;

a front cover pivotably secured to a front section of said base and having on an inside an upper eye for hooking said assembly into storage position, a lower eye to which a lower section of said tube is fastened and a small magnet centrally attached to a top rim of said front cover; and a back cover secured to a back section of said base and attached to a front wall of said water tank by at least one suction cup and having a small magnet centrally attached to a rim facing the magnet of said front cover, said magnets interacting to keep said front and back covers shut and said funnel assembly contained in the storage position.

* * * * *